US006342662B1

(12) United States Patent
Chang

(10) Patent No.: US 6,342,662 B1
(45) Date of Patent: Jan. 29, 2002

(54) TUNE CHANGEABLE PANPIPE WITHOUT HARMING THE LIPS OF A PLAYER

(76) Inventor: Yin-Yao Chang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/773,445

(22) Filed: Jan. 30, 2001

(51) Int. Cl.[7] ..... G10D 13/08

(52) U.S. Cl. ..... 84/402; 84/330; 84/383 R; 84/377

(58) Field of Search ..... 84/402, 377, 378, 84/383 R, 398, 384, 382, 380 B, 330, 331

(56) References Cited

U.S. PATENT DOCUMENTS 880,709 A * 3/1908 Barlow ..... 84/378
3,224,315 A * 12/1965 Guinness ..... 84/383 R
4,770,080 A * 9/1988 Jivoin ..... 84/330

* cited by examiner

*Primary Examiner*—Shih-yung Hsieh

(57) ABSTRACT

A tune changeable panpipe without harming the lips of a player includes a slightly arcuate alignment blow pipes lateral combined with each other and a plurality of sound pipes of different lengths and different diameters engaged with the bottom of the blow pipes on one by one basis from a longest one gradually to a shortest one. This disclosure is characterized in that each of the blow pipes has a smooth slope adjacent a mouthpiece without harming the lips of the players and a plurality of spare sound pipe are prepared to replace with those in the blow pipe in order to change the scale of music.

3 Claims, 5 Drawing Sheets

TUNE CHANGEABLE PANPIPE WITHOUT HARMING THE LIPS OF A PLAYER

BACKGROUND OF THE INVENTION

The present invention relates to musical instruments and more particularly to a tune changeable panpipe which has a smooth mouthpiece without harming the lips of a player.

Typical panpipe (as shown in FIGS. 1 and 2) comprises generally an alignment of sound pipes 1 combined together. The pipes 1 are arranged gradually from a longest one to a shortest one and from the largest diameter to the smallest diameter. The mouthpieces 2 of the pipes are formed by two U-shaped slopes so as to define a sharp edge on the top. When plays, the panpipe is moved to and fro in the mouth. Many students who study to play this panpipe are stopped on halfway because their lips are always harmed by the sharp edge. Besides, the sound pipes 1 are fixed that can not incorporate with the changes of notes in music.

SUMMARY OF THE PRESENT INVENTION

The present invention has a main object to provide a tune changeable panpipe without harming the lips of a player which has smooth mouth pieces not harming the lips of a player.

Another object of the present invention is to provide a tune changeable panpipe without harming the lips of a player in which the sound pipes are changeable to incorporate the changes of notes in music.

Accordingly, the tune changeable panpipe without harming the lips of the present invention comprises generally an arcuate alignment of blow pipes each of which has a smooth mouthpiece without harming the lips of the player and a plurality of sound pipes engaged with the blow pipes. The sound pipes are arranged from the longest one gradually to the shortest one and from the largest diameter to the smallest diameter so as to represent different notes in music. There is a plurality of spare sound pipes prepared to change the corresponding sound pipes in the panpipe when changes the rhyme of music.

The present invention will become more fully understood by reference to the following detailed description thereof when read in conjunction with the attached drawings.

DETAILED DESCRIPTION OF THE PREFERRED EMBODIMENT

Figure 1:
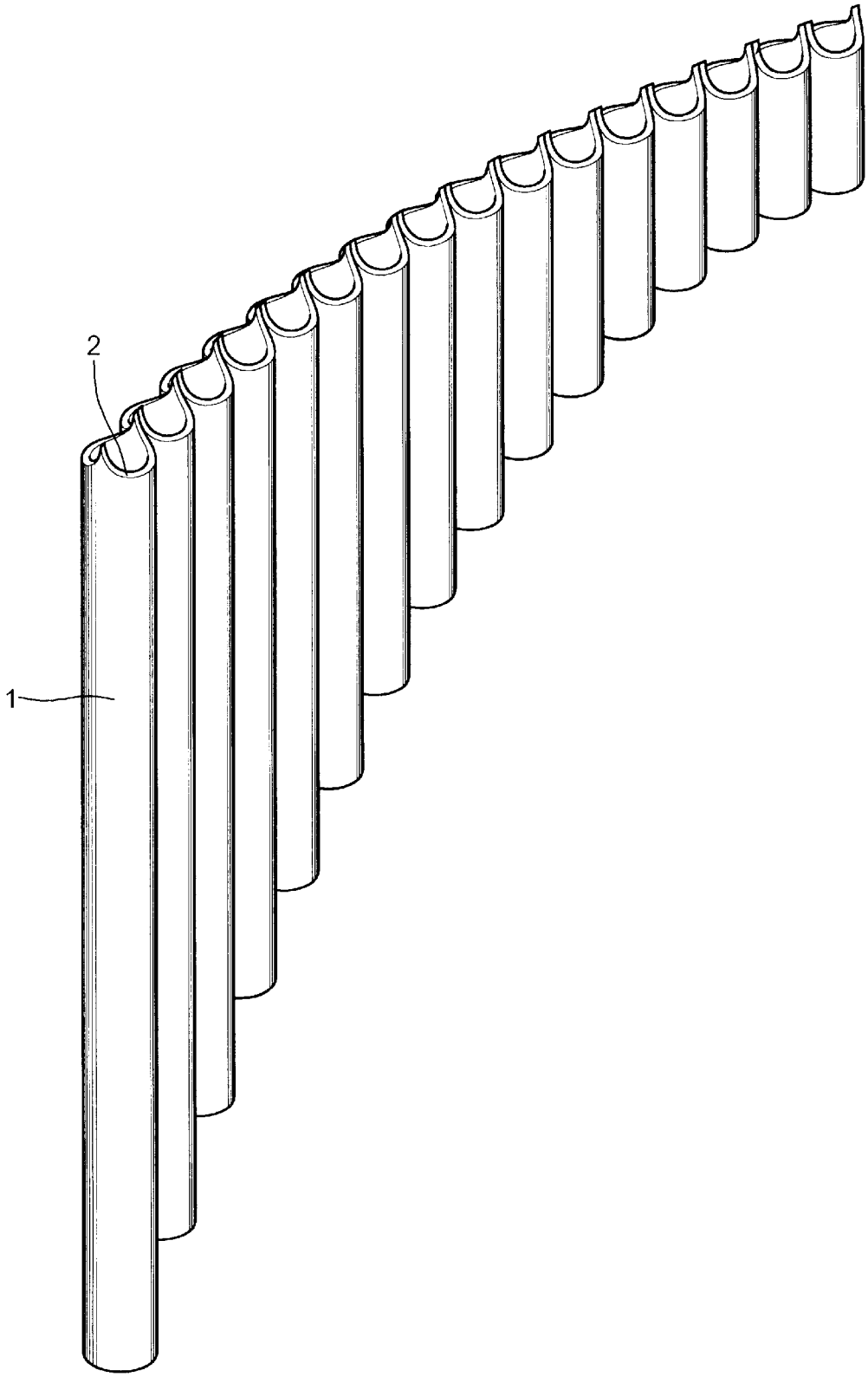
FIG.1 (Prior Art)
FIG. 1 is a perspective view to show a panpipe according to a prior art.
Figure 2:
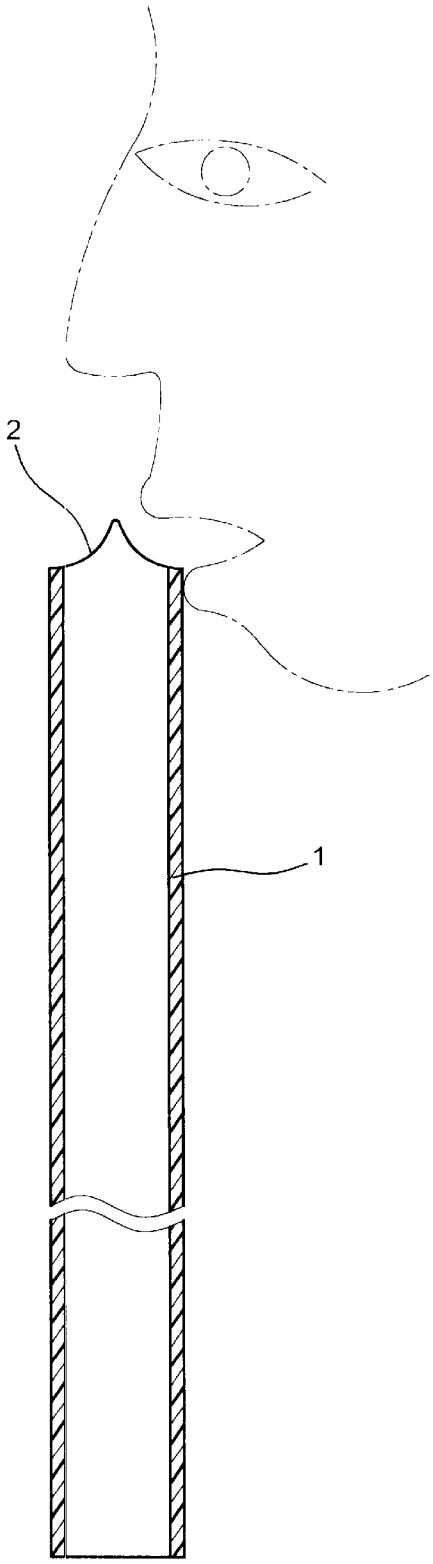
FIG.2 (Prior Art)
FIG. 2 is a sectional view of FIG. 1 indicating the mouth of a player engaged with the sharp edge of the mouthpiece.
Figure 3:
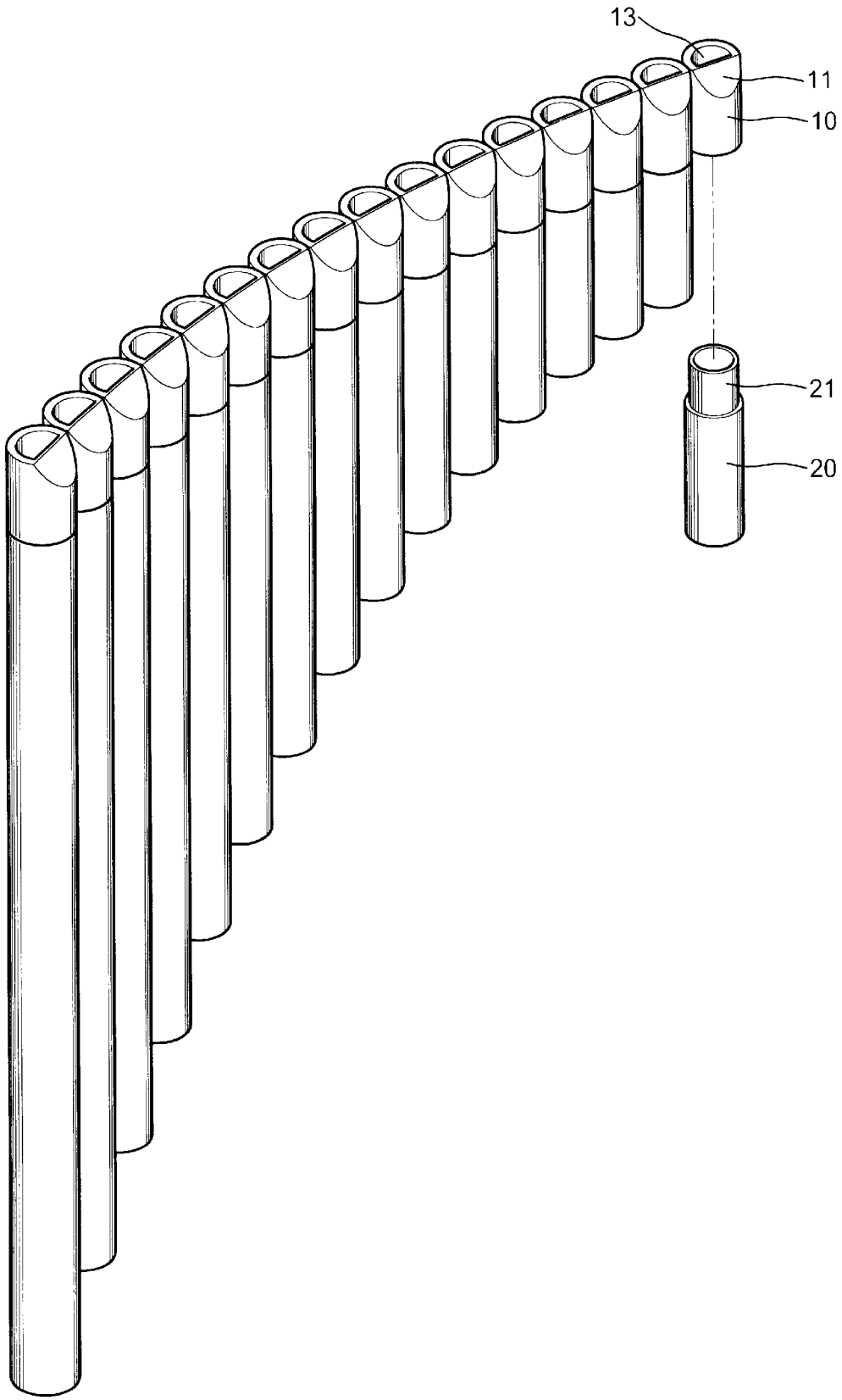
FIG. 3 is an exploded perspective view to show the preferred embodiment according to the present invention.
Figure 4:
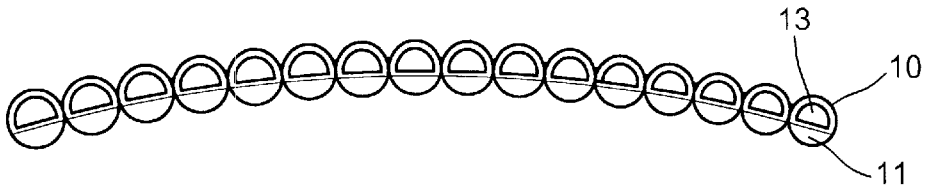
FIG. 4 is a top view of FIG. 3.
Figure 5:
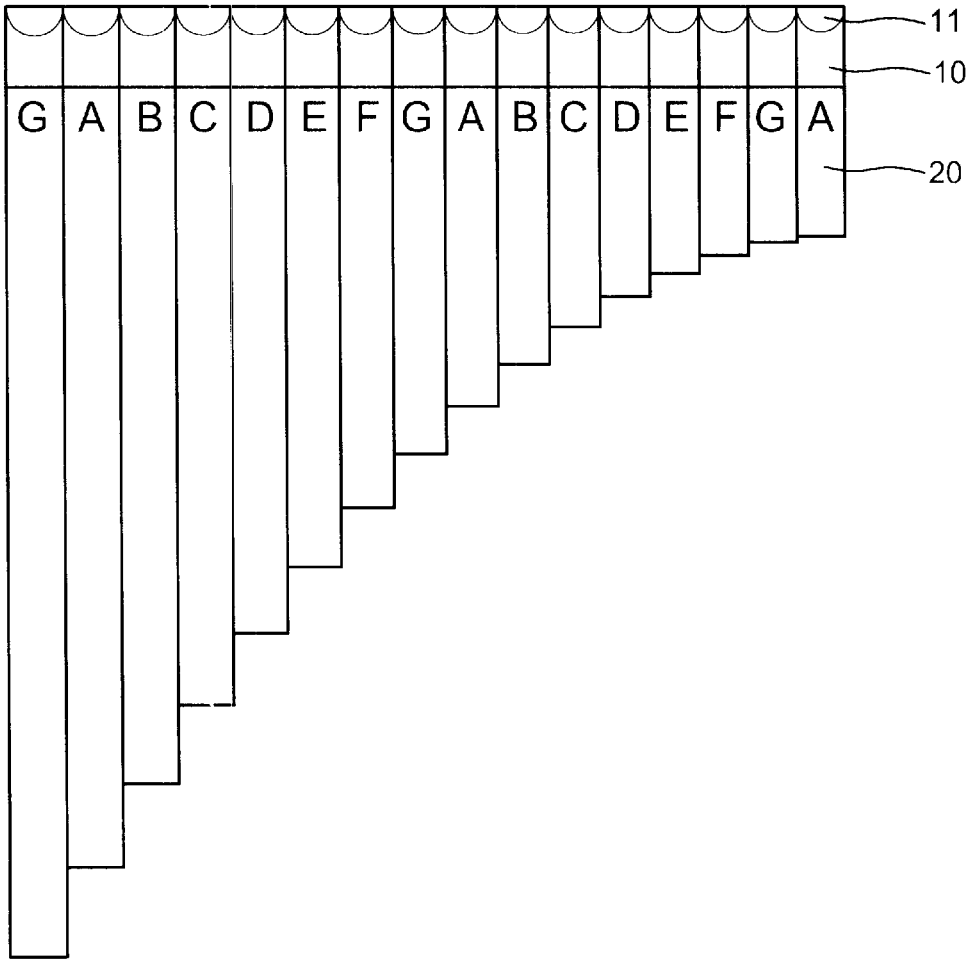
FIG. 5 is a plane view of FIG. 3.
Figure 6:
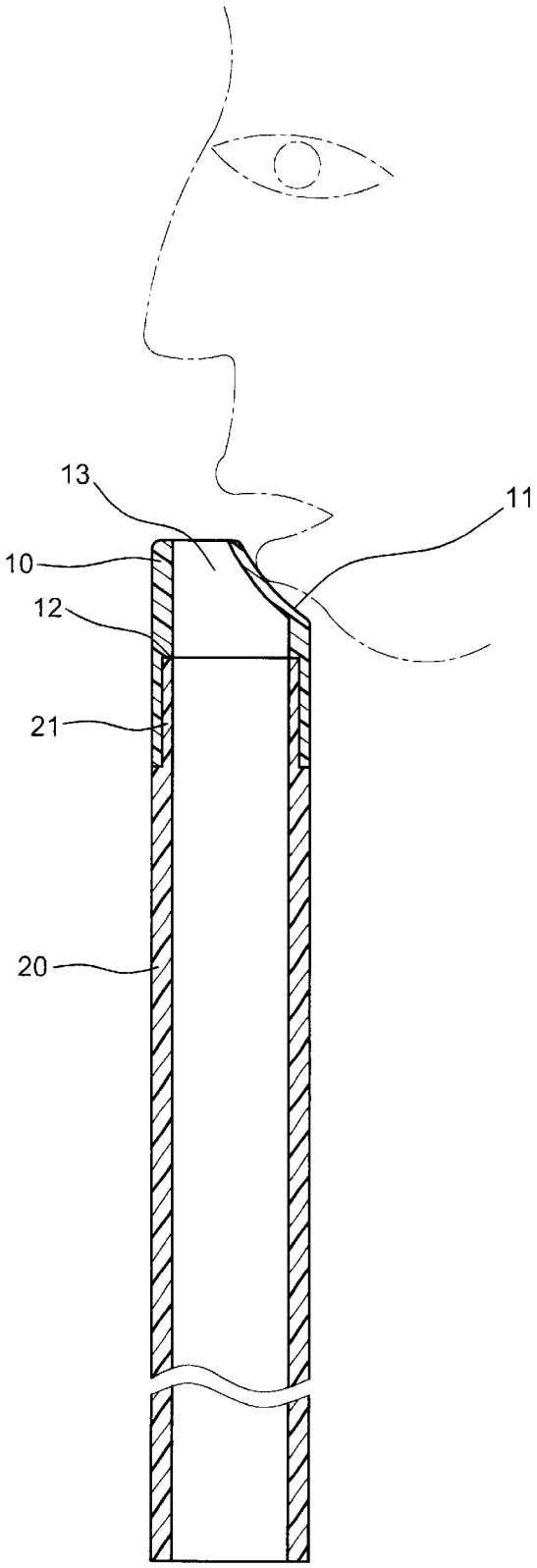
FIG. 6 is a sectional view indicating that the-mouth of a player engages with the smooth mouthpiece of the panpipe of the present invention.

With reference to FIGS. 3 to 6 of the drawings, the tune changeable panpipe without harming the lips of a player of the present invention comprises generally a plurality of blow pipes 10 laterally combined with each other to form a slightly arcuate alignment each having smooth slope 11 on one side adjacent a semi-circular mouthpiece 13 in the top of the blow pipe 10 and an annular shoulder 12 inside the blow pipe (as shown in FIG. 6), and a plurality of sound pipes 20 each having a reduced portion on the top engaged into the bottom of the blow pipes 10 with the top of the reduced portion stopped against the annular shoulder 12 of the blow pipe 10. The sound pipes have different lengths and different diameters in order to give off different sounds. The sound pipes 20 are pressedly engaged into the blow pipes 10 on one by one basis from the longest one gradually to the shortest one which has the smallest diameter. The panpipe is played as a harmonica moved to and fro through the mouth of the player without harming the lips of the player because. The smooth slopes 11 of the blow pipes define no any sharp edge between the mouthpieces 13.

There is a plurality of spare sound pipes such as $C^{\#}D^{\#}F^{\#}G^{\#}A^{\#}$ which are prepared to replace with the sound pipes 20 in the blow pipes 10 in order to change the scale of music. For instance, if replace the B, E sound pipe from the C scale with $C^{\#}$, $F^{\#}$ respectively, it will become D scale and if replace B, E in the C scale with the sound pipes $B^{b}$ ($A^{\#}$) $E^{b}$ ($D^{\#}$), it will become $B^{b}$ scale. So that spare sound pipes provide many functions to change the scale of music.

The panpipe of the present invention has many features and advantage set forth as follows:

a) the smooth slope 11 of the blow pipes will not harm the lips of the player so as to promote the interesting of the learner who will more mature in playing.

b) the spare sound pipes provide great function to change the scale of music.

c) the sound pipes 20 can be disassembled with blow pipes 10 in order to save the space to pack up.

The specification relating to the above embodiment should be construed as exemplary rather than as limitative of the present invention, with many variations and modifications being readily attainable by a person of average skill in the art without departing from the sprit or scope thereof as defined by the appended claims and their legal equivalents.

I claim:

1. a tune changeable panpipe comprising:

a plurality of blow pipes laterally combined with each other on one by one basis to make a slightly arcuate alignment, said blow pipes each having a smooth slope adjacent a semicircular mouthpiece on top thereof and a shoulder formed in an inner periphery thereof;

a plurality of sound pipes of different lengths and different diameters engaged into bottom of the blow pipes, said sound pipes each having a reduced portion on top pressedly engageable with the bottom of the blow pipes and slopped against the shoulder of the blow pipe;

whereby said panpipe is moved to and fro in the mouth of a player without harming the lips of the player.

2. The tune changeable panpipe as recited in claim 1 wherein said sound pipes are engaged with the blow pipe on one by one basis from a longest one gradually to a shortest one.

3. The tune changeable panpipe as recited in claim 1 further has a plurality of spare sound pipes of $C^{\#}D^{\#}F^{\#}G^{\#}A^{\#}$which are prepared to replace with the sound pipes of the blow pipes to change the scale of music.

* * * * *